US007275555B2

(12) United States Patent
Powell et al.

(10) Patent No.: US 7,275,555 B2
(45) Date of Patent: Oct. 2, 2007

(54) CANOPY TRUSS

(75) Inventors: Billy R. Powell, Lillington, NC (US); Tony A. Powell, Fuquay-Varina, NC (US); David R. Powell, Lillington, NC (US)

(73) Assignee: Powell & Powell Supply Company, Inc., Fuquay-Varina, NC (US)

( * ) Notice: Subject to any disclaimer, the term of this patent is extended or adjusted under 35 U.S.C. 154(b) by 556 days.

(21) Appl. No.: 10/328,810

(22) Filed: Dec. 24, 2002

(65) Prior Publication Data

US 2004/0118443 A1 Jun. 24, 2004

(51) Int. Cl.
*E04B 1/32* (2006.01)
*E04B 7/08* (2006.01)
*E04C 12/18* (2006.01)

(52) U.S. Cl. ..... 135/122; 135/121; 135/145; 135/158; 52/641; 52/645

(58) Field of Classification Search ..... 135/122, 135/121, 141, 143, 144, 145, 158, 908; 52/222, 52/92.1, 641, 645, 639, 691, 693, 695
See application file for complete search history.

(56) References Cited

U.S. PATENT DOCUMENTS 1,374,300 A * 4/1921 Henry ..... 135/122
1,961,915 A * 6/1934 Salmen, Jr. ..... 135/153
2,135,961 A * 11/1938 Chenoweth ..... 135/154
2,513,729 A * 7/1950 Lemen ..... 135/122
3,969,869 A * 7/1976 Partridge ..... 52/639
4,056,327 A * 11/1977 Daus et al. ..... 403/172
4,066,089 A * 1/1978 Rainwater ..... 135/151
5,167,246 A * 12/1992 Mortenson ..... 135/153
5,584,311 A * 12/1996 Schaefer ..... 135/128
5,730,281 A * 3/1998 Powell et al. ..... 206/223
6,047,513 A * 4/2000 Gibson ..... 52/646
6,170,503 B1 * 1/2001 Lin Shy ..... 135/119
6,173,726 B1 1/2001 Talmadge
6,360,509 B1 3/2002 Sluiter
6,367,495 B1 * 4/2002 Powell et al. ..... 135/122
6,374,843 B1 * 4/2002 Zou ..... 135/145
6,382,224 B1 * 5/2002 Carter ..... 135/145
6,666,223 B2 * 12/2003 Price et al. ..... 135/131

* cited by examiner

*Primary Examiner*—Amy J. Sterling
(74) *Attorney, Agent, or Firm*—Coats & Bennett, P.L.L.C.

(57) ABSTRACT

A canopy of the type that is typically packaged in a kit form that permits consumers to assemble a group of pipe members into a canopy structure. Once assembled and erected, the canopy includes a series of vertical posts and a series of rafters that extend upwardly from the post. In order to provide additional structural support, especially to the rafters and to the roof structure formed by the rafters, a series of cross or brace members are interconnected between the vertical posts and the rafters. These cross or brace members are arranged in sets with each set including two brace members that extend between a pair of vertical posts and a pair of rafters. The brace members, vertical posts and rafters form a truss network that imparts structural strength and rigidity to the overall canopy frame structure.

27 Claims, 4 Drawing Sheets

CANOPY TRUSS

FIELD OF THE INVENTION

The present invention relates to canopies having a metal frame structure and a pliable top cover. More particularly, the present invention relates to canopies that are typically marketed in kit form where the consumer actually erects and builds the canopy.

BACKGROUND OF THE INVENTION

Canopy kits have been immensely popular over the last five years. These kits, typically sold in mass merchandise outlets, comprise a tubular frame structure that basically comprise vertical posts, rafter sections, horizontal connecting sections, ridge connecting sections, and connectors for connecting these various tubular components together. In many cases, where erected, the canopy forms an elongated frame structure having a pliable cover that extends over the roof section of the structure. For a better appreciation of these canopy structures, one is referred to the disclosures found in U.S. Pat. Nos. 6,155,280 and 6,367,495, the disclosures of which are expressly incorporated herein by reference.

The popularity of these canopy kits can be attributed to a number of factors. First, they have great utility. They can be used to shelter vehicles, boats, and farm equipment and can even be used as party tents or shelters for roadside vendors. Secondly, these canopy structures are relatively inexpensive. Because of their usefulness and affordability, these ready to assemble canopy kits have met with tremendous success in the United States as thousands upon thousands have been sold.

For the most part, the erected canopy structure basically includes a side frame structure and a roof or rafter frame structure that extends above and connects between the side frame structure. That is, in many designs that have been sold in the United States, there has been no intermediate structure or structure extending beneath the rafter frame structure for imparting additional support.

Generally, these canopy structures have functioned well, and from a structural point of view, have not been prone to failure. Some conventional canopy designs have been known to fail when required to support substantial snow loads. Therefore, there has been and continues to be a need for a more sturdy or stronger frame structure for canopies that are sold in geographical areas that experience substantial snow.

SUMMARY OF THE INVENTION

The present invention entails a canopy structure that when erected includes a side frame structure and a rafter frame structure that extends upwardly above the side frame structure. An interconnecting structure extends between the side frame structure and the rafter frame structure such that the side frame structure, rafter frame structure and interconnecting structure form a truss network. The interconnecting structure includes a plurality of sets of members, with each set of members including first and second members. The first member is connected at one end to the side frame structure and extends generally diagonally across the canopy where the other end is connected to the rafter frame structure. The second member is connected at one end to the side frame structure about the opposite side of the canopy and extends generally diagonally therefrom where the other end is connected to the rafter frame structure. As the first and second members extend across the canopy, they cross in an area underneath the roof frame structure and inwardly of the side frame structure. A pliable cover is also provided for the canopy.

The present invention further comprises a method for erecting a canopy. This method entails interconnecting a structure between the side frame structure and the rafter frame structure. In one particular embodiment, the overall frame structure of the canopy includes a series of post-rafter sets, with each post-rafter set including a pair of vertical posts and a pair of rafters extending above the post with the pair of rafters and pair of posts all being generally aligned. The method of the present invention entails interconnecting a pair of cross members or braces between respective post-rafter sets of the canopy. These cross members or braces are connected such that each set of cross members or braces cross in an area underneath the rafters and inwardly of the posts. Therefore, it is appreciated that the interconnecting cross members or braces provide additional support for the rafters or roof structure of the canopy.

Other objects and advantages of the present invention will become apparent and obvious from a study of the following description and the accompanying drawings which are merely illustrative of such invention.

DESCRIPTION OF EXEMPLARY EMBODIMENT

With further reference to the drawings, the canopy of the present invention is shown therein and indicated generally by the numeral 10. Typically, canopy 10 would be manufactured and produced in sections, packaged in a box and distributed to consumers in kit form. See for example, U.S. Pat. No. 6,155,280. From the canopy kit, the consumer can assemble and erect a canopy structure in the form shown in FIG. 1.

Figure 1:
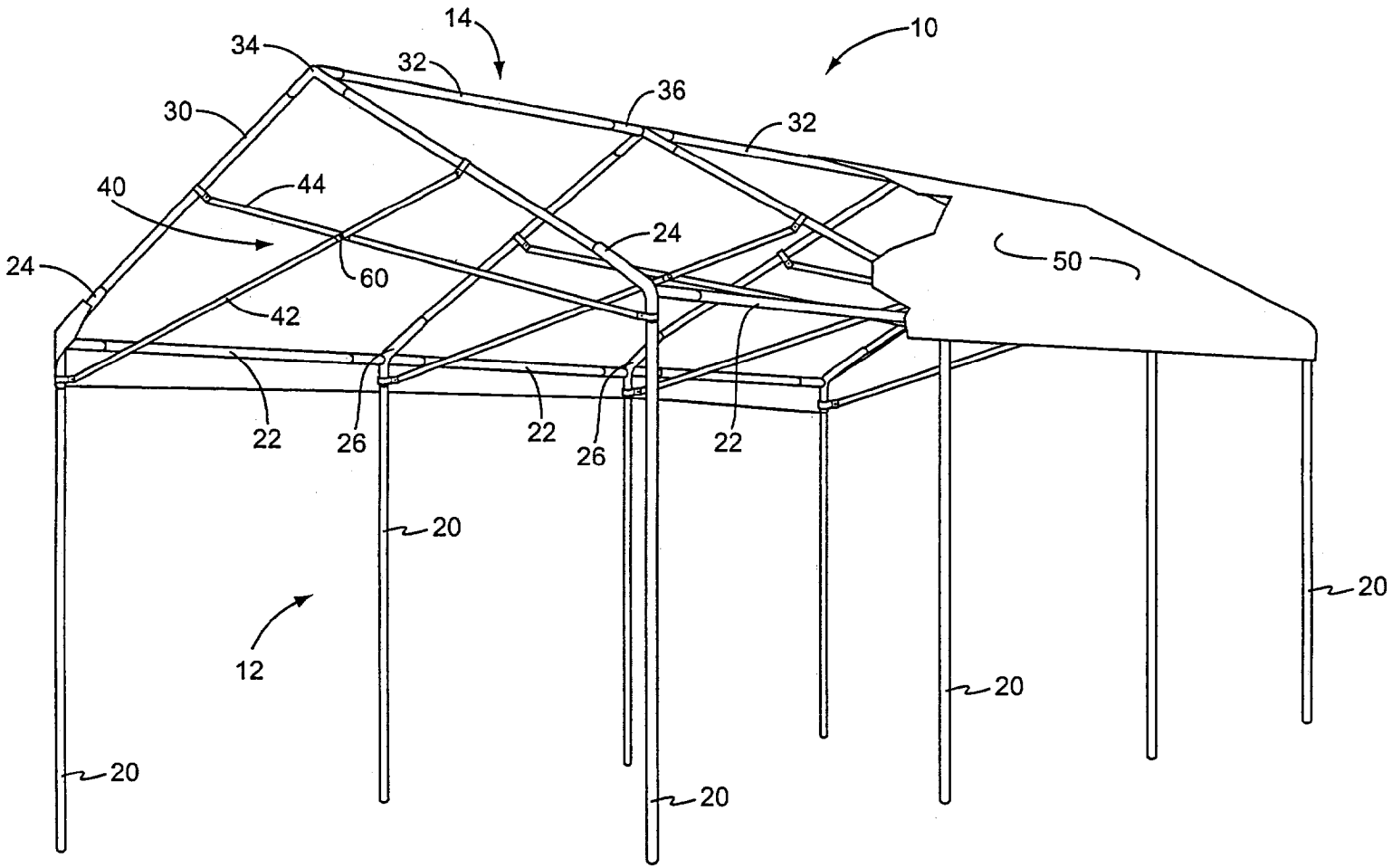
FIG. 1 is a perspective view of the canopy of the present invention with a portion of the cover broken away to better illustrate the frame structure of the canopy.

Describing the canopy 10 in an assembled and erected form and with particular reference to FIG. 1, the canopy structure includes a mainframe structure that comprises a side frame structure indicated generally by the numeral 12 and a rafter frame structure indicated generally by the numeral 14. In the case of the embodiment shown herein, the side frame structure 12 is disposed on opposite sides of the canopy 10, while the rafter frame structure 14 generally extends between the opposed portions of the side frame structure 12.

Figure 4:
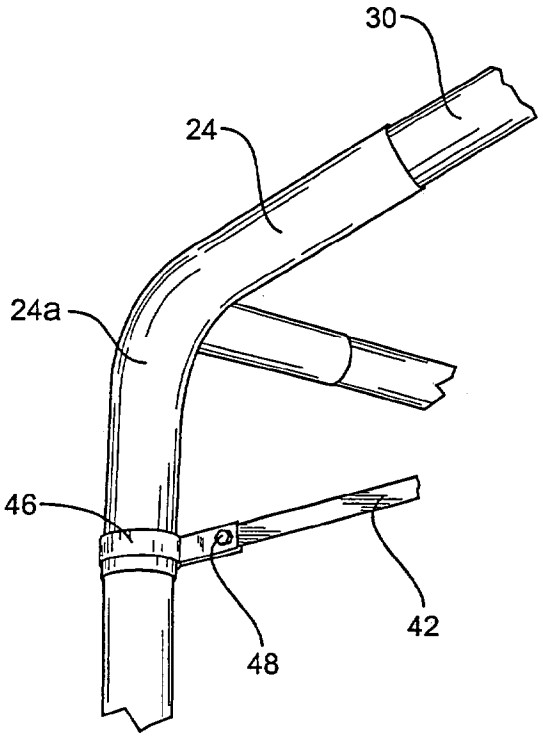
FIG. 4 is a fragmentary perspective view illustrating the connection of one of the cross or brace members to the frame structure of the canopy.

Viewing the side frame structure 12 in more detail, the same includes a series of posts 20 that extend in a generally vertical orientation when the canopy 10 is erected. As shown in FIG. 1, the posts 20 are disposed on opposite sides of the canopy 10. The individual posts 20 are interconnected by a series of horizontal members 22. There is provided various connectors for connecting the side frame structure 12 and the rafter frame structure 14. More particularly, there is provided a number of connectors for connecting the individual posts 20 with the horizontal members 22. As appreciated by those skilled in the art, in many canopy designs, the frame structure is made up of tubular or pipe stock where various sections of the tubular stock are designed to be connected by simply inserting one end portion of one component into an end portion of another component. In this embodiment, the various components of the frame structure are in the form of tubular members. Continuing to discuss the connectors, as indicated in FIG. 1, there is provided two types of connectors for connecting the posts 20 to various other components of the canopy. First, there is a 3-way corner connector 24 that is utilized on the corners on the canopy 10 and which function to connect one post 20 to one horizontal member 22 and which also functions to connect to a rafter of the rafter frame structure 14. A second connector, referred to as a 4-way intermediate connector 26, is utilized to connect one post 20 with two horizontal members 22 and with a rafter of the rafter frame structure 14. As illustrated in the drawings, particularly FIG. 4, the connectors 24 and 26 include a downward extending section that in FIG. 4 is simply referred to by 24*a*, that fits around an upper portion of a respective post 20. The term post, as used herein, refers to the actual post 20 and to the lower section of any connector that connects to or overlaps in any way with the post. Thus, for example, the portion 24*a* referred to in FIG. 4 would be considered a part of the post, again as that term is used herein.

Now turning to the rafter frame structure 14, this part of the overall frame structure includes a plurality of rafters 30. As can be seen from FIG. 1, there are a section of rafters 30 disposed on one side of the canopy 10 and another section of rafters 30 disposed on the other side of the canopy 10. Each rafter 30 includes opposed ends and an intermediate portion or section extending between the opposed ends. Further, the rafter frame structure includes a plurality of ridge sections 32. The ridge sections are adapted to extend between pairs or a series of rafters 30 and as seen in FIG. 1, form the ridge of the canopy 10. There are also a number of connectors that function to connect the rafters to the ridge sections 32. In this regard, there is provided a 3-way ridge connector 34. This 3-way ridge connector 34 would be found on opposite ends of the rafter frame structure 14 and each such connector functions to connect two rafters 30 to a single ridge section 32. Next, there is a 4-way ridge connector 36. This 4-way ridge connector functions to connect two ridge sections 32 to two rafters 30.

The lower ends of the rafters 30 are designed to be connected to the previously discussed connectors 24 and 26. That is, the end rafters 30 are designed to connect to the upper section or arm of the 3-way connector 24. Likewise, the lower portion of certain rafters 30 is designed to connect to the upper section or arm of the 4-way connector 26.

Thus, it is appreciated that the overall frame structure is comprised of the posts 20, rafters 30, horizontal members 22, ridge members 32, and the various 3-way and 4-way connectors. Therefore, as viewed in FIG. 1, it is seen that the particular embodiment illustrated herein shows a mainframe structure wherein the rafter frame structure 14 includes an upper elevated portion. In this case, the individual rafters 30 form an A-shaped roof that includes an apex or a ridge. Note also that in this embodiment, pairs of individual posts 20 are transversely aligned. Likewise, pairs of rafters 30 are transversely aligned. Further, each pair of posts 20 are generally transversely aligned with a pair of aligned rafters 30. Thus, for convenience, a post-rafter set is referred to as comprising a pair of aligned posts and a pair of aligned rafters.

Figure 2:
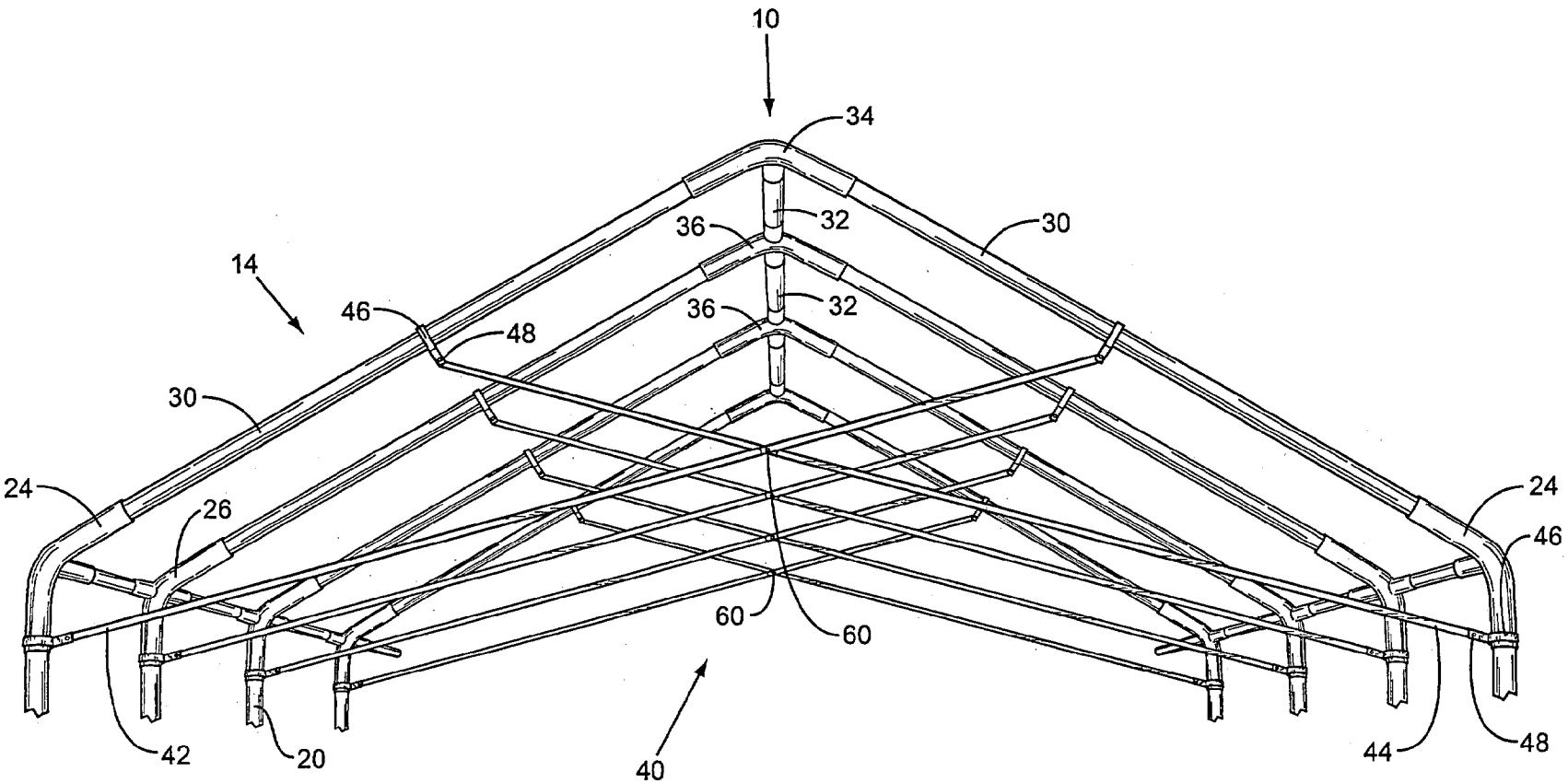
FIG. 2 is a fragmentary and elevational view of the frame structure of the canopy illustrating the interconnecting cross or brace members.

To provide additional support for the roof structure and particularly the rafter frame structure 14, there is provided an interconnecting structure indicated generally by the numeral 40. This interconnecting structure 40 generally extends between respective post-rafter sets. More particularly, the interconnecting structure 40 is disposed in sets with each set including two members 42 and 44, sometimes referred to as first and second members. FIG. 2 illustrates a plurality of sets of first and second members 42 and 44, which are also sometimes referred to as braces or cross members. Note that each set of the brace members 42 and 44 extend between a pair of aligned rafters 30 and a pair of posts 20. As seen in the drawings, the lower ends of the respective brace members 42 and 44 are actually connected about the lower section of the respective connectors 24 and 26. However, as stated herein before, the lower sections of these connectors are still considered a part of the post 20.

Figure 3:
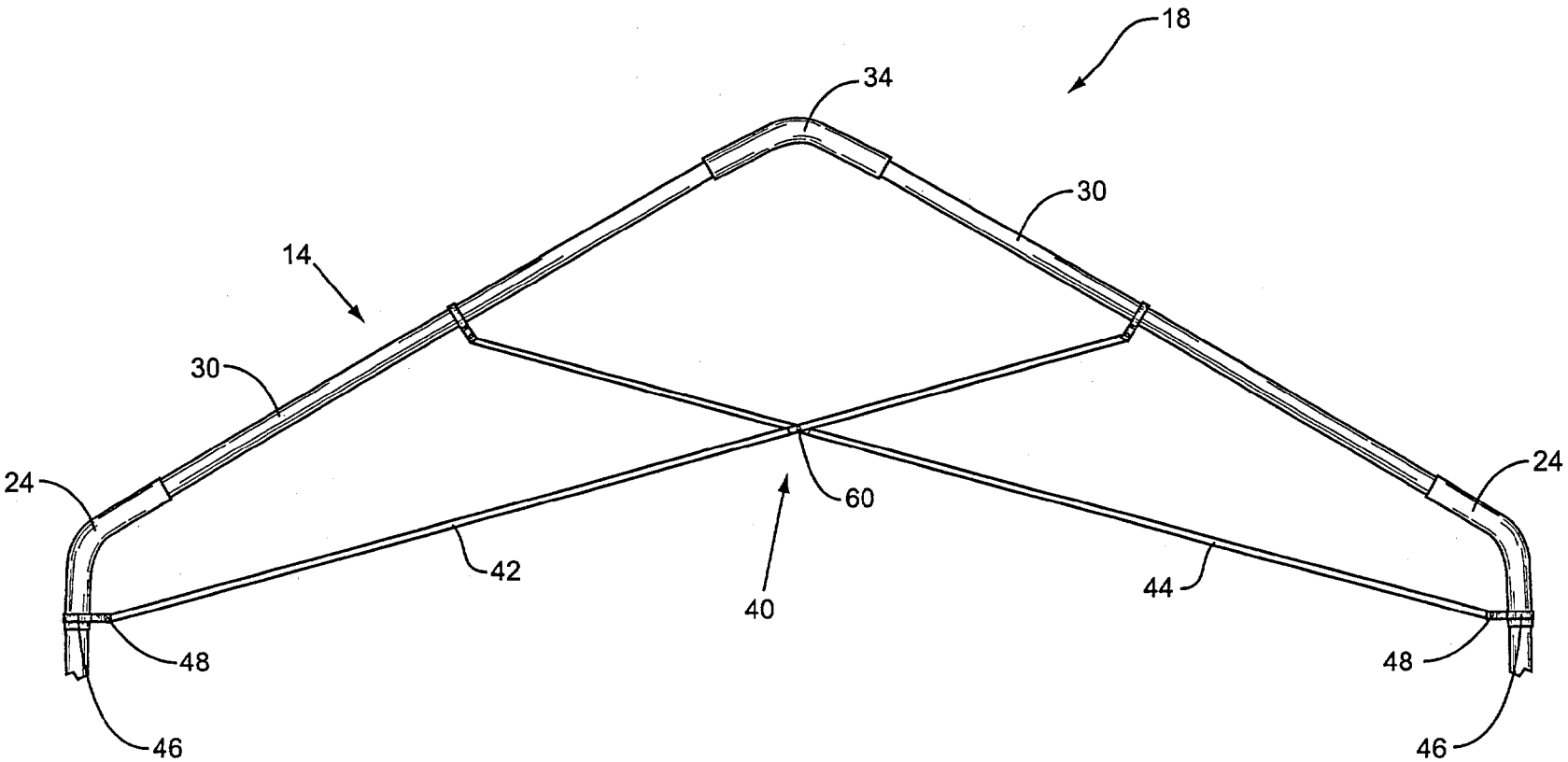
FIG. 3 is an elevational view of a portion of the frame structure of the canopy illustrating one section of the frame structure with two interconnecting cross or brace members.

Accordingly, as viewed in FIG. 2, the individual sets of members 42 and 44 are longitudinally spaced down the canopy 10. Each post-rafter set is interconnected as illustrated in FIGS. 2 and 3 with a pair of cross members 42 and 44. FIG. 3 simply illustrates one post-rafter set and a pair of brace or cross members 42 and 44. Note that the cross members 42 and 44 cross underneath the rafters 30 and underneath the apex or ridge of the rafter frame structure 14. More particularly in the embodiment disclosed herein, the brace members 42 and 44 cross at a point that is generally vertically aligned with the ridge or apex of the rafter frame structure 14.

Figure 5:
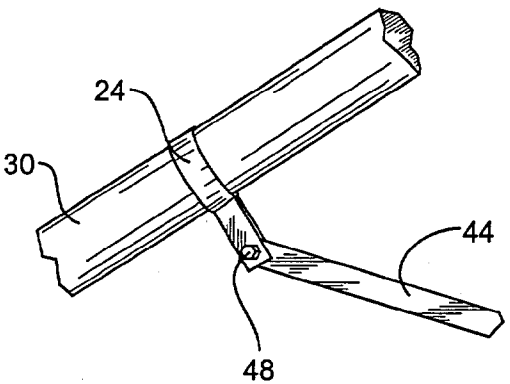
FIG. 5 is a perspective view illustrating one of the cross or brace members connected to a rafter of the rafter frames structure.

To connect each brace member 42 and 44, there is provided a ring clamp 46 and a bolt assembly 48. As illustrated in FIGS. 4 and 5, the ring clamp 46 fits tightly around the frame structure being connected to and bolts to an end of a respective brace member 42 and 44. In the embodiment illustrated herein, the brace members 42 and 44 are formed of a generally flat stock or structure but it should be appreciated that other cross sectional variations such as a tubular member, square member or rectangular member could be utilized. As seen in FIG. 3, the connection points between the ends of the brace members 42 and 44 with the various portions of the frame structure are at an angle. That is, where the brace members 42 and 44 connect to the rafters 30, it is seen that the ring clamp 46 forms an angle with respect to the respective brace member 42 and 44. Even where the brace members 42 and 44 connect with the post, as viewed in FIG. 3, there is at least a slight angle formed. Note also that the brace members 42 and 44 connect to the individual rafters 30 about an intermediate portion, that is a portion of the respective rafters between their opposed ends. The connecting point with the posts is at a point above the midpoint height of the respective posts. In the case of the embodiment illustrated herein, the lower ends of brace members 42 and 44 connect to the post at a point or area just below the juncture formed by the connectors 24 and 26.

When the canopy 10 is erected, and a load is placed on the roof, it follows that the brace members 42 and 44 are held in tension. This provides additional strength and rigidity to the roof structure and particularly to the individual rafters 30 that form a part of the rafter frame structure 14. Further, the brace members 42 and 44 along with the other portions of the frame structure including the posts 20 and the rafters 30 form a truss network.

Preferably, the cross or brace members 42 and 44 are bolted together in the area where they cross.

Figure 6:
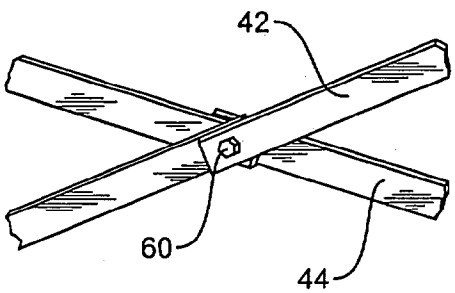
FIG. 6 is a fragmentary perspective view showing the cross members connected by bolt assembly at the point or area where they cross.

The two members are spaced from each other such that they crisscross, but do not structurally intersect. That is that the two members pass in a side-by-side relationship and are not disposed in the same plane. This is illustrated in FIG. 6. In one embodiment, each cross member 42 or 44 can be provided in two sections. This will facilitate packaging and shipping. When the cross members 42 and 44 are provided in two sections, the inner ends, that is all four ends, are bolted together by a bolt assembly 60. This particular arrangement is illustrated in FIG. 6. It's further appreciated that in other embodiments the cross members or braces 42 and 44 would simply be in the form of a single elongated member. As shown in FIG. 1, the canopy is provided with a pliable cover 50 that extends over the rafters 30.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A canopy structure, comprising:

a. a series of posts;

b. a plurality of rafters extending upwardly above the posts, the rafters forming a generally A-shaped roof having an apex;

c. a plurality of diagonal brace sets interconnected between the posts and rafters;

d. each diagonal brace set including a pair of members interconnected between a pair of posts and a pair of rafters;

e. the pair of members of each brace set crossing each other with each member of the pair extending underneath the apex defined by the rafters;

f. a pliable cover for extending over at least a portion of the rafters;

g. wherein each of the pair of members comprise a single structural member that extends uninterrupted between one post and one rafter, and wherein the pair of single structural members are spaced from each other such that they crisscross but not actually intercept; and h. wherein the area between the apex and where the structural members crisscross is open as there is no structural support provided between the apex and where the structural members crisscross.

2. The canopy of claim 1 wherein each member of the pair includes opposed end portions and wherein one end portion of each member is connected to an intermediate portion of a respective rafter.

3. The canopy of claim 2 wherein each post includes a mid-point height and wherein the other end portion of each member of the pair is connected to a respective post at a point above the mid-point height.

4. The canopy of claim 1 wherein the posts and rafters are transversely aligned in pairs and each pair form a post-rafter set, and wherein each brace set is interconnected between a post-rafter set.

5. The canopy of claim 4 wherein one member of each brace set is connected to one post of a post-rafter set and extends therefrom diagonally across the canopy to connect to a rafter of the post-rafter set, and wherein the other member of the brace set is connected to the other post of the post-rafter set and extends therefrom diagonally across the canopy to connect to the other rafter of the post-rafter set.

6. The canopy of claim 1 wherein each post includes an upper portion that forms a part of a connector that connects a rafter to the post.

7. The canopy of claim 6 wherein a portion of each post and the connector overlap and wherein each member of the brace set is connected at one end in the area of the overlapment.

8. A canopy comprising:

a. a plurality of posts;

b. a plurality of rafters;

c. the posts and rafters are adapted to be erected such that a pair of posts and a pair of rafters are generally aligned and form a post-rafter set;

d. first and second members interconnected between the posts and rafters of each post-rafter set;

e. the first member connected to one post of the post-rafter set and extending therefrom diagonally across the canopy and connecting to one rafter of the post-rafter set, and the second member connected to the other post of the post-rafter set and extending therefrom diagonally across the canopy and connected to the other rafter of the post-rafter set;

f. wherein the first and second members cross in an area between the two posts of the post-rafter set;

g. a pliable cover for extending over the rafters; and h. wherein a pair of posts and a pair of rafters, between which the pair of members extend, are transversely aligned; and wherein the pair of members crisscross at a crisscross point and wherein at the crisscross point one member is spaced from the other member such that the pair of members do not structurally intersect at the crisscross point.

9. The canopy of claim 8 wherein the rafters form a generally A-shaped roof that includes a ridge, and wherein both said first and second members extend across and below the ridge.

10. The canopy of claim 9 wherein each rafter includes opposite ends and an intermediate section, and wherein the first and second members are connected to the intermediate section of respective rafters.

11. The canopy of claim 10 wherein each post includes an upper portion and wherein the first and second members are connected to the upper portions of the respective posts.

12. The canopy of claim 8 wherein the canopy is elongated and includes a plurality of post-rafter sets with the posts and rafters of each set being transversely aligned; and wherein the first and second members extend between the posts and rafters of each post-rafter set.

13. A method of erecting a canopy, comprising:

a. positioning a plurality of posts in vertical positions and aligning the posts in spaced-apart relationship in at least two rows;

b. extending a plurality of rafters upwardly above the posts and aligning the rafters in pairs and aligning each pair of aligned rafters with a pair of aligned posts;

c. connecting a first member with a first rafter and extending the first member across the canopy and connecting the first member at a point below the first rafter;

d. connecting a second member with a second rafter which is generally aligned with the first rafter and extending the second member from the second rafter across the canopy and connecting the second member at a point below the second rafter;

e. wherein the first and second members cross in an area underneath at least a portion of the first and second rafters;

f. securing a pliable cover to the canopy;

g. wherein the first member comprises a single structural member that extends uninterrupted between the first rafter and a transversely aligned post; and wherein the second member is a single structural member that extends uninterrupted from the second rafter to an aligned post;

h. wherein the first and second member crisscross, but do not actually structurally intersect; and i. wherein at the point where the first and second members crisscross, the first and second members are spaced such that they pass each other in side-by-side relationship.

14. The method of claim 13 wherein aligned posts and rafters form a post-rafter set, and wherein the first and second members are connected between each post-rafter set.

15. The method of claim 13 wherein the rafters form a generally A-shaped roof having a ridge and wherein the first and second members extend across and below the ridge.

16. The method of claim 15 wherein the first and second members cross at a point vertically aligned with the ridge.

17. A canopy kit that when erected comprises:

a. a side frame structure;

b. a rafter frame structure that extends upwardly above the side frame structure;

c. an interconnecting structure extending between the side frame structure and the rafter frame structure such that the side frame structure, rafter frame structure, and interconnecting structure form a truss network;

d. the interconnecting structure including a plurality of sets of members, with each set of members including first and second members;

e. the first member connected at one end to the side frame structure and extending generally diagonally therefrom where the other end is connected to the rafter frame structure;

f. the second member connected at one end to the side frame structure and extending generally diagonally therefrom where the other end is connected to the rafter frame structure;

g. the first and second members crossing in an area underneath the rafter frame structure and inwardly of the side frame structure;

h. a pliable cover for being secured to the rafter frame structure; and i. wherein a pair of posts and a pair of rafters, between which the pair of members extend, are transversely aligned; and wherein the pair of members crisscross at a crisscross point and wherein at the crisscross point one member is spaced from the other member such that the pair of members do not structurally intersect at the crisscross point.

18. The canopy kit of claim 17 wherein the rafter frame structure includes a central elevated portion and wherein the first and second members cross underneath the central elevated portion.

19. The canopy of claim 18 wherein the respective first and second members cross at a point that is generally vertically aligned with the central elevated portion of the rafter frame structure.

20. The canopy kit of claim 17 wherein the rafter frame structure is of a generally A-shape and includes a ridge, wherein the first and second members cross in an area underneath the ridge and wherein the first and second members cross in an area that is generally vertically aligned with the ridge.

21. The canopy kit of claim 17 where the side frame structure includes a midpoint height and wherein the first and second members are connected to the side frame structure at a height above the midpoint height.

22. The canopy kit of claim 17 wherein the rafter frame structure includes a series of rafters, each rafter including opposed ends and an intermediate section and wherein the first and second members are connected to the intermediate section of respective rafters.

23. The canopy kit of claim 22 wherein the side frame structure includes a series of posts with the posts being disposed on opposite sides of the canopy, and wherein respective posts are aligned with respective rafters of the rafter frame structure, and wherein a pair of posts and a pair of rafters are generally aligned and form a post-rafter set, and wherein the first and second members are interconnected between the post-rafter set.

24. The canopy structure of claim 8 wherein each of the pair of members comprise a single structural member that extends uninterrupted between one post and one rafter.

25. The canopy structure of claim 24 wherein the area between the apex and where the structural members crisscross is open as there is no structural support provided between the apex and where the structural members crisscross.

26. The canopy structure of claim 17 wherein each of the pair of members comprise a single structural member that extends uninterrupted between one post and one rafter.

27. The canopy structure of claim 26 wherein the area between the apex and where the structural members crisscross is open as there is no structural support provided between the apex and where the structural members crisscross.

* * * * *